US012733674B2

(12) United States Patent
Song

(10) Patent No.: US 12,733,674 B2
(45) Date of Patent: Sep. 15, 2026

(54) MANUAL CIGARETTE MAKER

(71) Applicant: Wenzhou Haoke Electrical Appliance Co., Ltd., Wenzhou (CN)

(72) Inventor: Guosheng Song, Wenzhou (CN)

(73) Assignee: Wenzhou Haoke Electrical Appliance Co., Ltd., Wenzhou (CN)

( * ) Notice: Subject to any disclaimer, the term of this patent is extended or adjusted under 35 U.S.C. 154(b) by 362 days.

(21) Appl. No.: 18/646,809

(22) Filed: Apr. 26, 2024

(65) Prior Publication Data

US 2025/0040588 A1 Feb. 6, 2025

(30) Foreign Application Priority Data

Aug. 4, 2023 (CN) ..... 202322090944.X

(51) Int. Cl.
*A24C 5/40* (2006.01)

(52) U.S. Cl.
CPC ..... *A24C 5/40* (2013.01)

(58) Field of Classification Search
CPC .. A24C 5/40; A24C 5/42; A24C 5/425; A24C 5/44
See application file for complete search history.

(56) References Cited

U.S. PATENT DOCUMENTS

2014/0202471 A1* 7/2014 Bao ..... A24C 5/42 131/108
2022/0408796 A1* 12/2022 Liu ..... A24C 5/425

* cited by examiner

*Primary Examiner* — Alicia J Weydemeyer
*Assistant Examiner* — Laura B Figg
(74) *Attorney, Agent, or Firm* — Bayramoglu Law Offices LLC

(57) ABSTRACT

A manual cigarette maker include a housing and a mounting frame fixed inside the housing. A front side of the mounting frame is provided with a discharge assembly, and a middle part of the mounting frame is provided with a pressing assembly. The discharge assembly includes a discharge pipe. The pressing assembly includes a pressing element. A pressing chamber for pressing a material is formed between a front side of the pressing element and the discharge pipe. The pressing assembly is linked with the discharge pipe through a drive assembly. The drive assembly includes a rotatable drive shaft, a swing arm, a linkage, and a drive plate. The swing arm is configured to link the discharge pipe and the drive shaft. A drive wheel is provided on the drive shaft and rotates synchronously with the drive shaft. The linkage includes a gear part and a connecting part.

10 Claims, 6 Drawing Sheets

MANUAL CIGARETTE MAKER

CROSS REFERENCE TO THE RELATED APPLICATIONS

This application is based upon and claims priority to Chinese Patent Application No. 202322090944.X, filed on Aug. 4, 2023, the entire contents of which are incorporated herein by reference.

TECHNICAL FIELD

The present disclosure belongs to the field of cigarette makers, and in particular to a manual cigarette maker.

BACKGROUND

Cigarettes are cylindrical tobacco products with a length of about 100 mm and a diameter of 8 mm, which are made by machines by drying tobacco, shredding the dried tobacco, and rolling tobacco shreds with cigarette paper. The cigarette making process involves turning large mature tobacco leaves into small pieces of compressed tobacco through high-temperature steaming, sorting, and cutting; shredding the compressed tobacco into tobacco shreds; and packing the tobacco shreds with filter tips to obtain finished cigarettes.

In the prior art, a manual cigarette maker includes a handle for driving a drive shaft to swing. The drive shaft is fixed to a hook plate with hooks on both sides. The hooks respectively clamp a swing arm and a parallel four-bar linkage provided on a side. The swing arm drives a discharge pipe to move. The parallel four-bar linkage drives a pressing plate. Due to the limitation of raw material cost and the limitation of volume of the cigarette maker, the parallel four-bar linkage is typically a thin hinged structure. The left and right fulcrums of the parallel four-bar linkage are easy to float up and down and sway left and right, causing abnormal sound during operation of the cigarette maker. In addition, the gaps between the four bars are easy to change, causing the pressing plate to float with the four bars. As a result, the accuracy of the pressing stroke is reduced, and the compactness of tobacco shreds are easily different in the left and right directions, affecting the user experience. The swing arm is provided with a lever spring which bypasses the main shaft. When the lever spring fails, the handle operates the swing arm and the parallel four-bar linkage to retreat at the same time. However, if there is foreign matter in the pressing chamber, it will be very difficult for them to retreat.

SUMMARY

The present disclosure provides a manual cigarette maker, which solves the problems existing in the prior art, such as poor uniformity of pressing, easy occurrence of abnormal sound, and difficult retreat of the discharge pipe operated by the handle in case the spring fails.

To solve the above technical problems, the present disclosure proposes the following technical solution.

A manual cigarette maker, including a housing and a mounting frame fixed inside the housing, where a front side of the mounting frame is provided with a discharge assembly, and a middle part of the mounting frame is provided with a pressing assembly; the discharge assembly includes a discharge pipe; the pressing assembly includes a pressing element; a pressing chamber for pressing a material is formed between a front side of the pressing element and the discharge pipe; the pressing assembly is linked with the discharge pipe through a drive assembly; the drive assembly includes a rotatable drive shaft, a swing arm, a linkage, and a drive plate; the swing arm is configured to link the discharge pipe and the drive shaft; a drive wheel is provided on the drive shaft and rotates synchronously with the drive shaft; the linkage includes a gear part provided on a side and a connecting part provided at a front side; the gear part is meshed with the drive wheel; and a front side of the drive plate is hinged with the pressing element, and a rear side of the drive plate is hinged with the connecting part of the linkage. The rotation of the drive shaft can be achieved through the handle or a knob. The operator only needs to add the tobacco shreds and the cigarette paper and operate corresponding components to rotate the drive shaft throughout the entire process, without the need for an additional button or structure to cause the discharge pipe to retreat. The design enhances the overall linkage performance of the cigarette maker, making it convenient and fast to use.

Preferably, continuous helical teeth are circumferentially arranged on a side surface of the drive wheel; the drive wheel is further provided with a smooth surface; the gear part of the linkage is a helical gear; when the helical teeth of the drive wheel are meshed with the gear part of the linkage, the drive wheel rotates horizontally and drives the gear part to rotate in a vertical plane; and when the smooth surface of the drive wheel is connected to the linkage, the drive wheel rotates horizontally and the gear part does not rotate. The drive part uses the helical gear to achieve linkage, which can convert horizontal rotation into vertical rotation of the gear part of the linkage, providing power for the pressing of the pressing plate.

Preferably, the drive wheel is provided with a torsion spring; an end of the torsion spring extends out of the drive wheel to a position at a junction between the helical teeth and the smooth surface of the drive wheel; the gear part of the linkage is fan-shaped; a front side of the gear part forms an end surface provided with a clamping groove; and when the smooth surface of the drive wheel is connected to the linkage, an extended part of the torsion spring butts into the clamping groove and provides an elastic force for reverse rotation of the drive wheel. The torsion spring provides the elastic force for the reverse rotation of the drive wheel. When pressing the material, the handle drives the drive wheel to swing upward, and the elastic potential energy for the reverse rotation gradually increases. After the pressing is completed, the torsion spring can automatically drive the drive wheel to reverse, causing the discharge pipe to automatically retreat, avoiding the situation where the operator does not retreat the discharge pipe and directly adds tobacco shreds, resulting in cigarette jamming. The entire process features semi-automatic operation, ensuring efficient and convenient operation.

Preferably, an end of the swing arm is rotatably mounted on the mounting frame; the swing arm is provided with a guide groove; a guide element is provided on the drive shaft and moves synchronously with the drive shaft; the guide groove includes an arc part and a guide part; when the helical teeth of the drive wheel are meshed with the gear part of the linkage, the guide element slides along the arc part; and when the smooth surface of the drive wheel is connected to the linkage, the guide element slides along the guide part and pushes the swing arm to swing.

Preferably, an angle is formed between the arc part and the guide part of the guide groove; and a groove wall of the arc part is shaped as a circular arc, with a center located on a central axis of the drive shaft.

Preferably, the guide element is cylindrical, and is mounted on the drive shaft through a mounting element; the mounting element is fixedly connected to the drive shaft; and a cylindrical side surface of the guide element is in contact with the guide groove.

Preferably, the discharge assembly further includes a discharge guide rail and a slider; the slider slides on the discharge guide rail; the slider is connected to the discharge pipe and drives the discharge pipe to move laterally; the slider is connected to the swing arm through a linkage arm; and one end of the linkage arm is hinged with the slider, and the other end of the linkage arm is connected to a front end of the swing arm.

Preferably, the drive shaft is connected to a handle for driving the drive shaft to rotate.

Preferably, when the pressing element moves backward, the housing forms a material inlet corresponding to the pressing chamber between the pressing element and the discharge pipe.

Preferably, the cigarette maker further includes a roll opening and a paper pressing assembly; the discharge pipe is configured to protrude from the roll opening when moving laterally; the paper pressing assembly includes a first push element and a second push element that are provided on a side of the mounting frame and a third push element provided on the mounting frame; the first push element is eccentrically connected to the linkage; the first push element moves forward and pushes a front end of the second push element to butt with the roll opening; and when the swing arm swings to a side of the roll opening, the swing arm contacts with the third push element and drives the third push element to rotate, and the third push element rotates to push the second push element to retreat.

With the above technical solutions, the present disclosure achieves significant technical effects.

If the torsion spring fails, the handle is manually operated to swing reversely. The drive wheel first drives the swing arm to swing backward, the discharge pipe moves backward, and the pressing plate is driven backward in a next stroke. The design avoids the discharge pipe failing to move backward due to material jamming, and greatly extending the service life of the cigarette maker.

The integral drive structure does not need to be fixed with screws. The linkage is meshed with the gear on the drive shaft and the drive plate is hinged with the linkage to change the traditional rigid-connection drive into flexible-connection drive. The design greatly improves the drive stability, improves the compaction stability, ensures that the tobacco shreds at each part of the discharge pipe are compacted, reduces the operation noise, and ensures the smooth operation.

It is not easy to jam at some drive part, which improves the operation safety of the cigarette maker.

Figure 1:
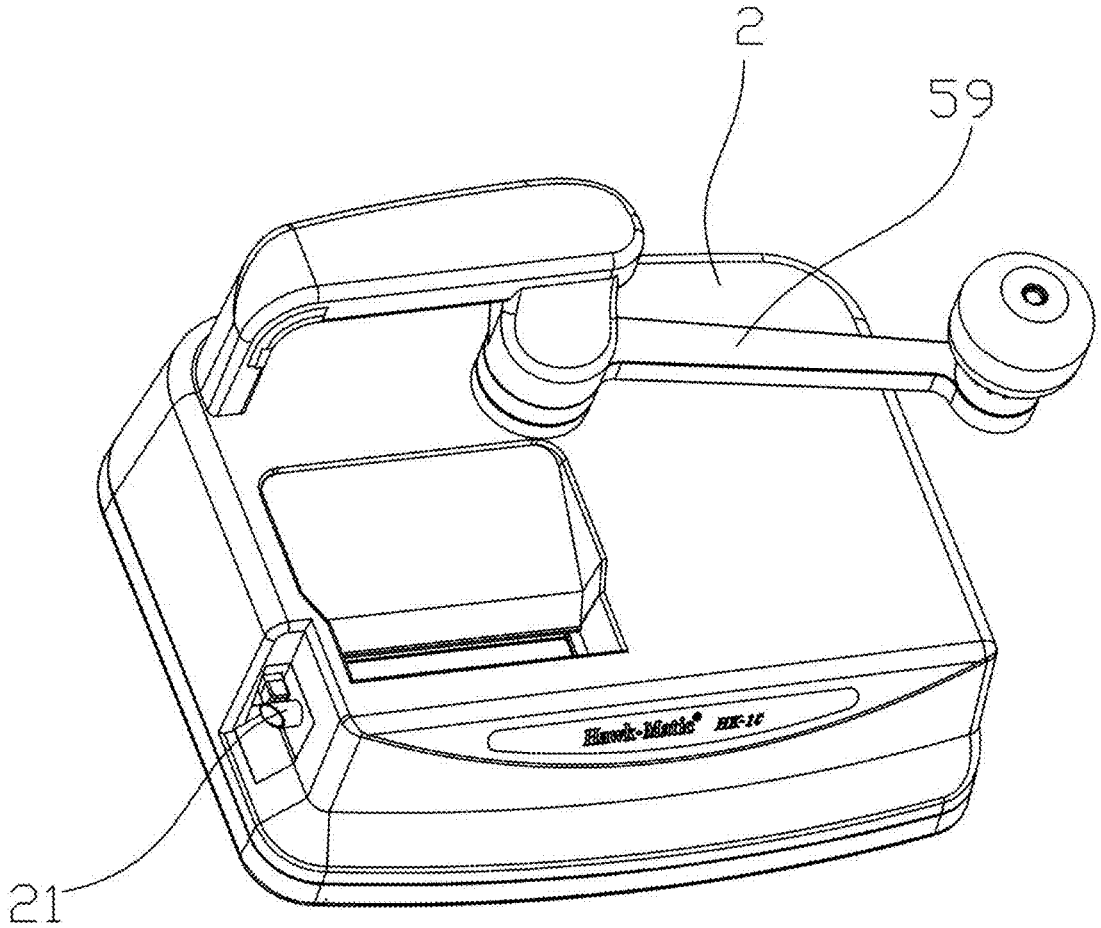
FIG. 1 is a schematic diagram of a manual cigarette maker according to the present disclosure.

Reference Numerals: 1. mounting frame; 2. housing; 21. roll opening; 31. discharge pipe; 32. discharge guide rail; 33. slider; 41. pressing element; 42. pressing chamber; 51. drive shaft; 52. swing arm; 521. guide groove; 5211. arc part; 5212. guide part; 53. linkage; 531. gear part; 5311. clamping groove; 532. connecting part; 54. drive plate; 55. drive wheel; 551. helical tooth; 56. torsion spring; 57. guide element; 571. mounting element; 58. linkage arm; 59. handle; 61. first push element; 62. second push element; and 63. third push element.

DETAILED DESCRIPTION OF THE EMBODIMENTS

The present disclosure is described in further detail below with reference to the drawings and embodiments.

Embodiment 1

Figure 2:
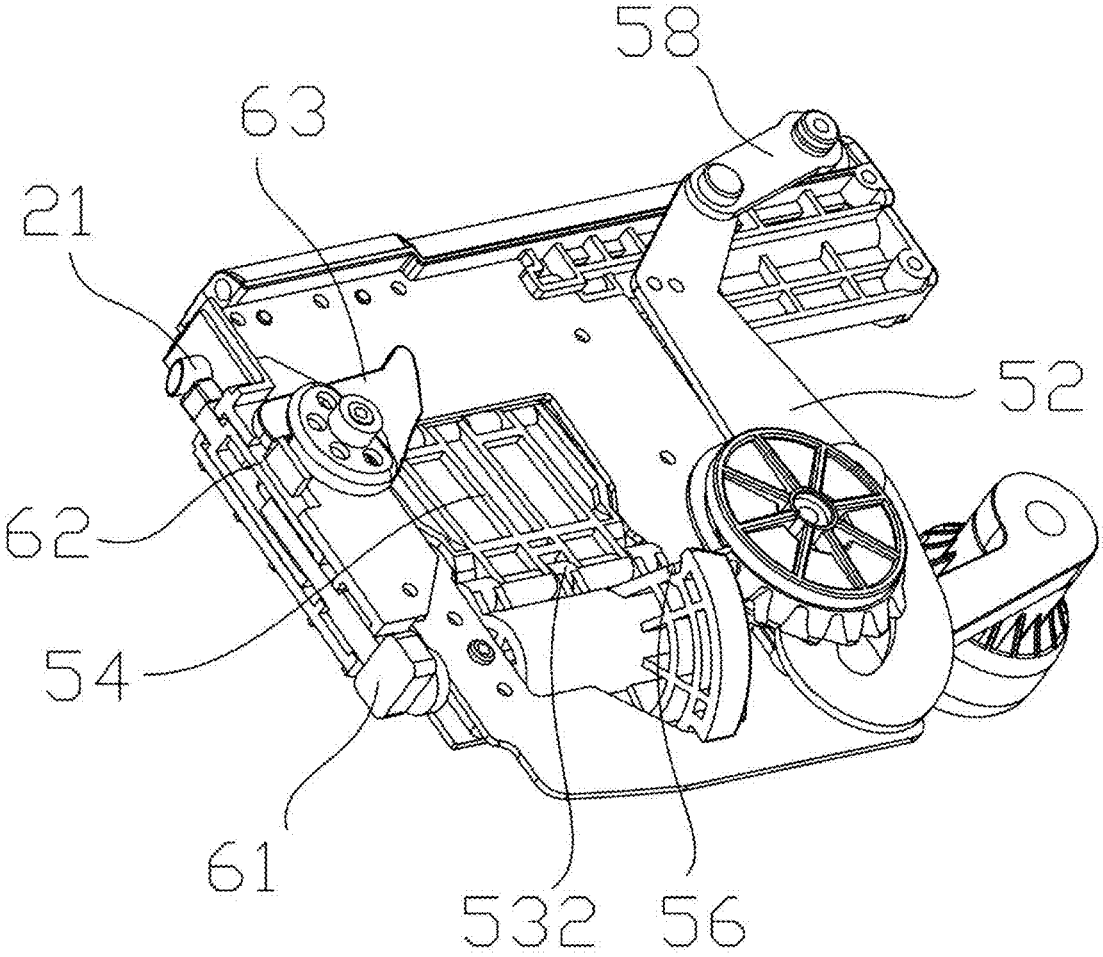
FIG. 2 is a schematic diagram of the manual cigarette maker with a housing removed according to the present disclosure.

As shown in FIGS. 1 and 2, a manual cigarette maker includes housing 2 and mounting frame 1 fixed inside the housing 2. A front side of the mounting frame 1 is provided with a discharge assembly, and a middle part of the mounting frame is provided with a pressing assembly. The discharge assembly includes discharge pipe 31. The pressing assembly includes pressing element 41. Pressing chamber 42 for pressing a material is formed between a front side of the pressing element 41 and the discharge pipe 31. The pressing assembly is linked with the discharge pipe 31 through a drive assembly. The drive assembly includes rotatable drive shaft 51, swing arm 52, linkage 53, and drive plate 54. The swing arm 52 is configured to link the discharge pipe 31 and the drive shaft 51. Drive wheel 55 is provided on the drive shaft 51 and rotates synchronously with the drive shaft. The linkage 53 includes gear part 531 provided on a side and connecting part 532 provided at a front side. The gear part 531 is meshed with the drive wheel 55. A front side of the drive plate 54 is hinged with the pressing element 41, and a rear side of the drive plate 54 is hinged with the connecting part 532 of the linkage 53.

Figure 3:
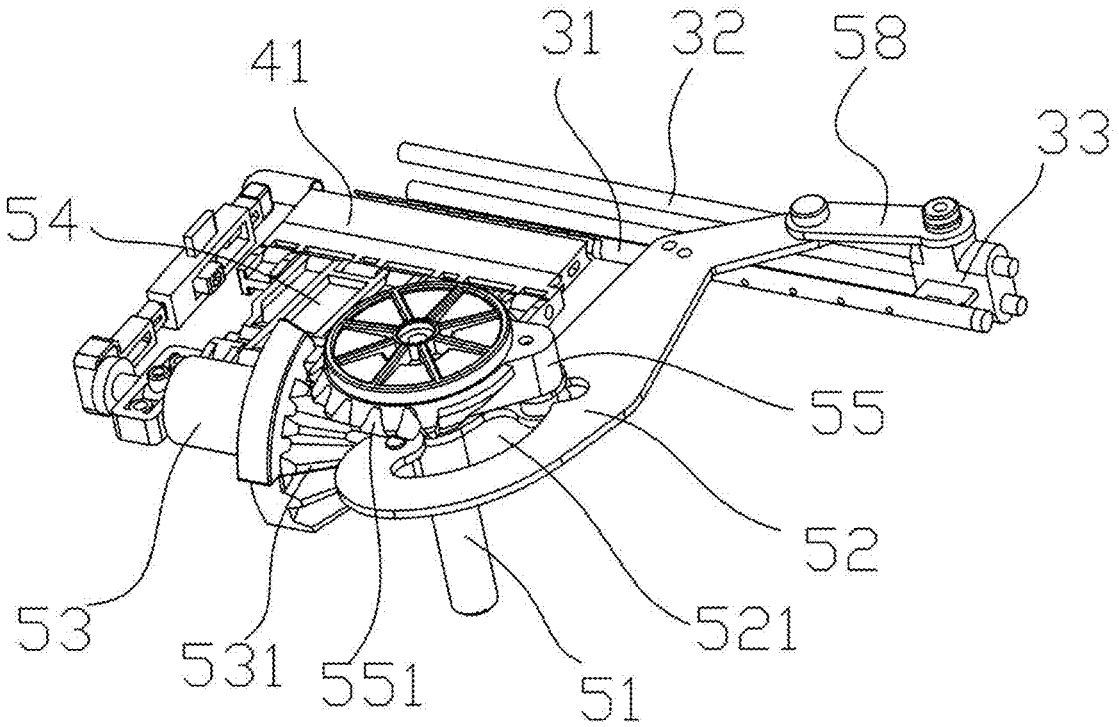
FIG. 3 is a schematic diagram of an internal part of the manual cigarette maker according to the present disclosure.
Figure 4:
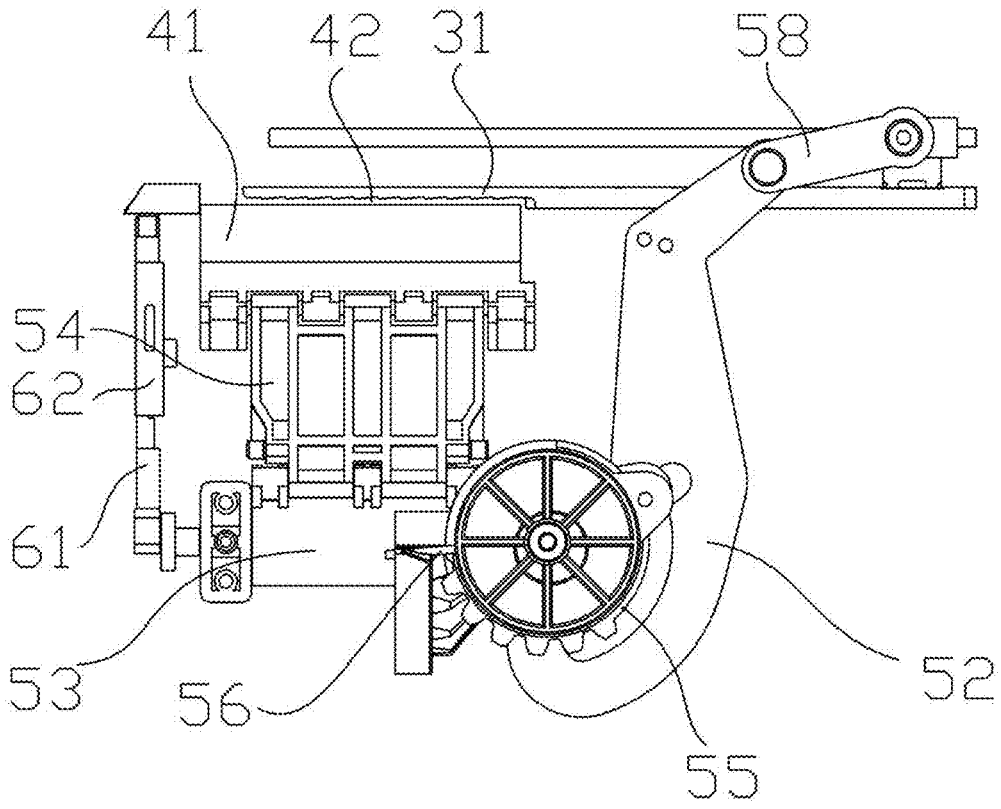
FIG. 4 is a top view of the internal part shown in FIG. 3.
Figure 5:
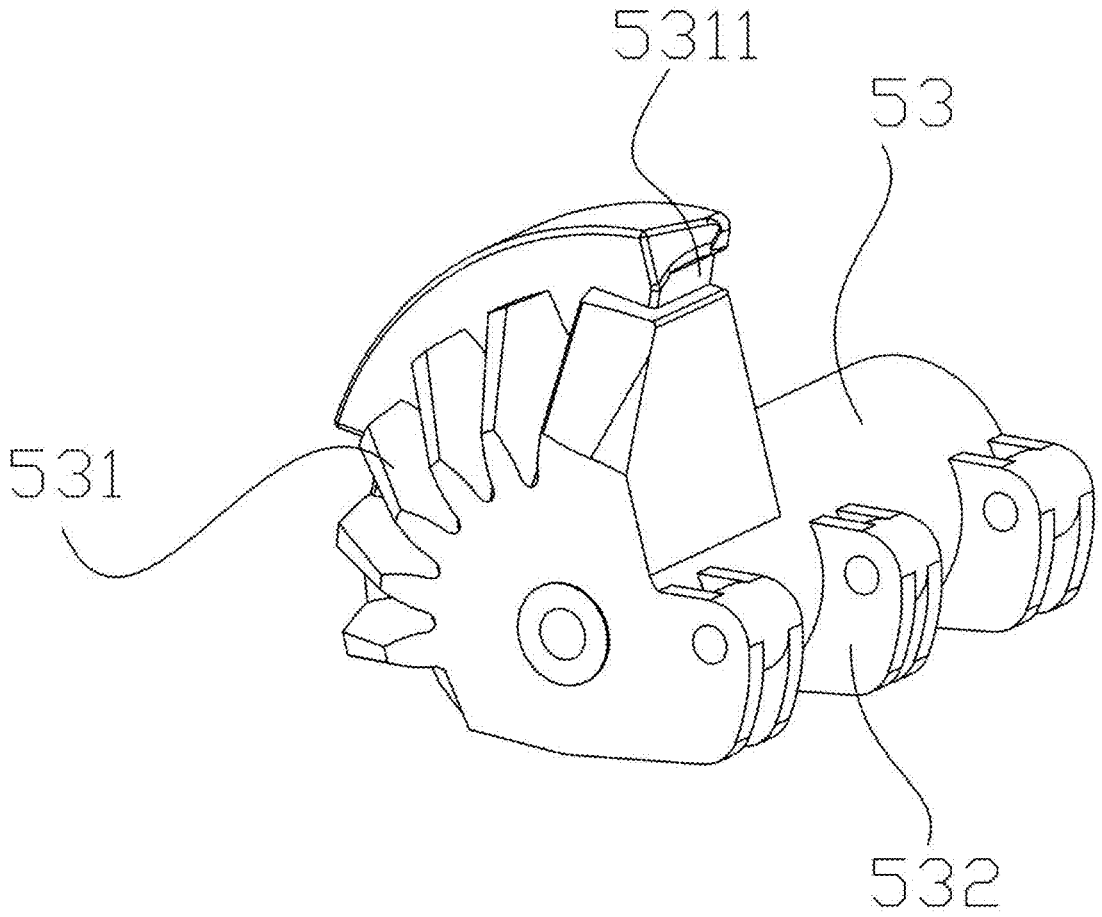
FIG. 5 is a schematic diagram of a linkage according to the present disclosure.

As shown in FIGS. 3 to 5, continuous helical teeth 551 are circumferentially arranged on a side surface of the drive wheel 55. The drive wheel 55 is further provided with a smooth surface. The gear part 531 of the linkage 53 is a helical gear. When the helical teeth 551 of the drive wheel 55 are meshed with the gear part 531 of the linkage 53, the drive wheel 55 rotates horizontally and drives the gear part 531 to rotate in a vertical plane. When the smooth surface of the drive wheel 55 is connected to the linkage 53, the drive wheel 55 rotates horizontally and the gear part 531 does not rotate.

As shown in FIGS. 3 and 4, the drive wheel 55 is provided with torsion spring 56. An end of the torsion spring 56 extends out of the drive wheel 55 to a position at a junction between the helical teeth 551 and the smooth surface of the drive wheel 55. The gear part 531 of the linkage 53 is fan-shaped. A front side of the gear part 531 is provided with an end surface. The end surface is provided with clamping groove 5311. When the smooth surface of the drive wheel 55 is connected to the linkage 53, an extended part of the torsion spring 56 butts into the clamping groove 5311 and provides an elastic force for reverse rotation of the drive wheel 55.

Figure 6:
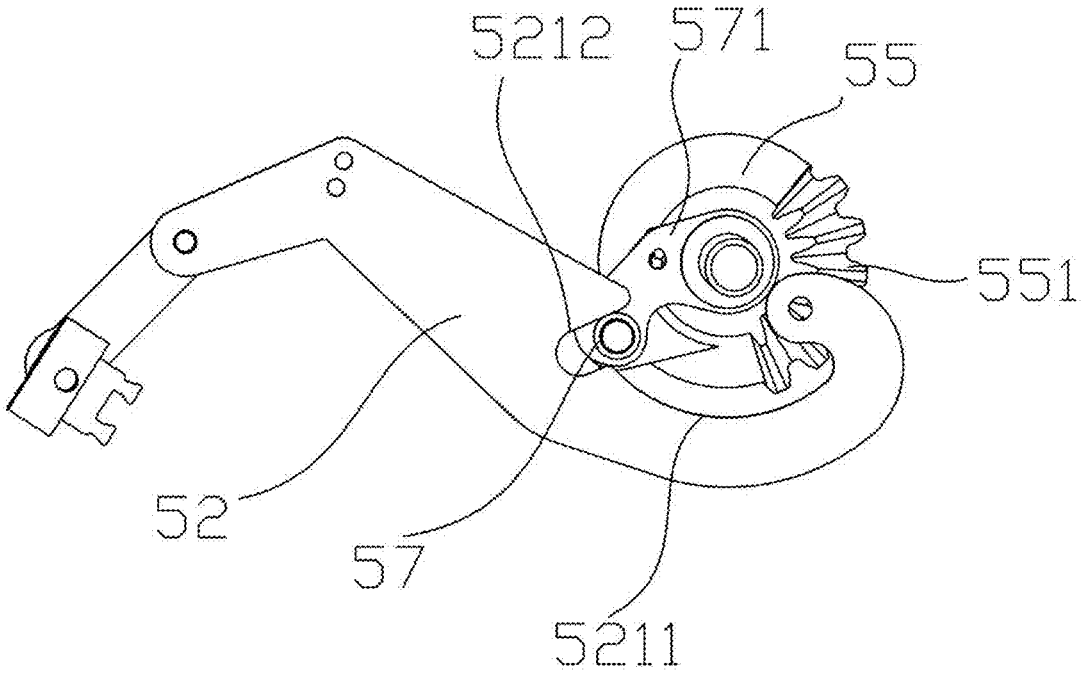
FIG. 6 is a schematic diagram of a drive wheel and a swing arm that are linked according to the present disclosure.

As shown in FIG. 6, an end of the swing arm 52 is rotatably mounted on the mounting frame 1. The swing arm 52 is provided with guide groove 521. Guide element 57 is provided on the drive shaft 51 and moves synchronously with the drive shaft 51. The guide groove 521 includes arc part 5211 and guide part 5212. When the helical teeth of the drive wheel 55 are meshed with the gear part 531 of the linkage 53, the guide element 57 slides along the arc part 5211. When the smooth surface of the drive wheel 55 is connected to the linkage 53, the guide element 57 slides along the guide part 5212 and pushes the swing arm 52 to swing.

An angle is formed between the arc part 5211 and the guide part 5212 of the guide groove 521. A groove wall of the arc part 5211 is shaped as a circular arc, with a center located on a central axis of the drive shaft 51. The guide element 57 is cylindrical, and is mounted on the drive shaft 51 through mounting element 571. The mounting element 571 is fixedly connected to the drive shaft 51. A cylindrical side surface of the guide element 57 is in contact with the guide groove 521.

The discharge assembly further includes discharge guide rail 32 and slider 33. The slider 33 slides on the discharge guide rail 32. The slider 33 is connected to the discharge pipe 31 and drives the discharge pipe 31 to move laterally. The slider 33 is connected to the swing arm 52 through linkage arm 58. One end of the linkage arm 58 is hinged with the slider 33, and the other end of the linkage arm 58 is connected to a front end of the swing arm 52.

The drive shaft 51 is connected to handle 59 for driving the drive shaft 51 to rotate.

The cigarette maker further includes roll opening 21 and a paper pressing assembly. When the discharge pipe 31 moves laterally, it can protrude from the roll opening 21. The paper pressing assembly includes first push element 61 and second push element 62 that are provided on a side of the mounting frame 1 and third push element 63 provided on the mounting frame 1. The first push element 61 is eccentrically connected to the linkage 53. The first push element 61 moves forward and pushes a front end of the second push element 62 to butt with the roll opening 21. When the swing arm 52 swings to a side of the roll opening 21, the swing arm 52 contacts with the third push element 63 and drives the third push element 63 to rotate, and the third push element 63 rotates to push the second push element 62 to retreat.

A specific working principle of the manual cigarette maker is as follows. In a first step, a user swings the handle 59 backward to an initial position. The drive shaft 51 rotates with the swing of the handle 59. The mounting element 571 is fixed to the drive shaft 51 and swings with the drive shaft at the same angle. The guide element 57 swings backward along the arc part 5211 of the guide groove 521 provided on the swing arm 52. The drive wheel 55 rotates with drive shaft 51. The helical teeth 551 of the drive wheel 55 are meshed with the gear part 531 of the linkage 53. The drive wheel 55 rotates horizontally. The linkage 53 is driven by the drive wheel 55 to rotate vertically forward at the same angle. The connecting part 532 of the linkage 53 swings upward and drives a rear end of the drive plate 54 hinged with it to swing upward. The pressing element 41 is limited longitudinally by the mounting frame 1 and can only move horizontally. The pressing element 41 and a front part of the linkage 53 move backward. When the pressing element 41 moves backward, the pressing element 41 exits from a state of blocking a material inlet of the housing 2. The housing 2 forms the material inlet corresponding to the pressing chamber 42 between the pressing element 41 and the discharge pipe 31.

In a second step, the user places a paper roll into the roll opening 21 and adds non-pressed tobacco shreds into the material inlet. The first push element 61 is eccentrically connected to the linkage 53. When the linkage 53 is driven by the drive wheel 55 to rotate vertically forward, the first push element 61 and the second push element 62 are limited by the mounting frame 21 vertically. The first push element 61 moves backward and drives the second push element 62 to move backward. The front end of the second push element 62 leaves the roll opening 21 to facilitate the user to place the paper roll into the roll opening 21 while the user adds non-pressed tobacco shreds into the material inlet.

In a third step, the tobacco shreds are pressed. The handle 59 swings upward from the initial position. The guide element 57 swings forward along the arc part 5211 of the guide groove 521 provided on the swing arm 52 until the guide element 57 just leaves the arc part 5211 and contacts with the groove wall of the guide part 5212. This process is a reverse process of the first and second steps. The drive shaft 51 rotates with the swing of the handle 59. The mounting element 571 is fixed to the drive shaft 51 and swings with it at the same angle. The guide element 57 swings forward along the arc part 5211 of the guide groove 521 provided on the swing arm 52. Since the center of the arc part 5211 falls on the central axis of the drive shaft 51, the swing arm 52 will not swing with the movement of the guide element 57 during this process. The drive wheel 55 on the drive shaft 51 rotates with the drive shaft 51. The helical teeth 551 of the drive wheel 55 are meshed with the gear part 531 of the linkage 53, and the drive wheel 55 rotates horizontally. The linkage 53 is driven by the drive wheel 55 to rotate vertically backward at the same angle. The connecting part 532 of the linkage 53 swings downward and drives the drive plate 54 hinged with it to swing downward. The pressing element 41 is limited longitudinally by the mounting frame 1 and can only move horizontally. The pressing element 41 and the front part of the linkage 53 move forward. The drive plate 54 switches from a rear swing up state to a horizontal state. When the pressing element 41 moves forward and presses the tobacco shreds in the pressing chamber 42, the tobacco shreds in the pressing chamber 42 are pressed toward the discharge pipe 31 and are compacted. The handle 59 swings until the guide element 57 just leaves the arc part 5211 and contacts with the groove wall of the guide part 5212.

In a fourth step, the pressed tobacco shreds are packed with cigarette paper. The handle 59 continues to swing upward. The helical teeth 551 of the drive wheel 55 are separated from the gear part 531 of the linkage 53. The smooth surface of the drive wheel 55 is connected to the linkage 53. The torsion spring 56 extends out of the drive wheel 55 and butts into the clamping groove 5311 on the front end surface of the gear part 531 of the linkage 53. The torsion spring 56 provides an elastic force for the reverse rotation of the drive wheel 55. When the handle 59 drives the drive wheel 55 to continue swinging upward, the elastic potential energy of reverse rotation gradually increases. The guide element 57 enters the guide part 5212 along the arc part 5211 of the guide groove 521 provided on the swing arm 52. The guide element 57 continues to swing. The guide element 57 is matched with the groove wall of the guide part 5212 such that the swing arm 52 is driven and swings toward the roll opening 21. The slider 33 is driven by the swing arm 52 and moves along the discharge guide rail 32 toward the roll opening 21. The linkage arm 58 plays a driving role. The slider 33 is fixedly connected to the discharge pipe 31, and drives the discharge pipe 31 with the compacted tobacco shreds toward the roll opening 21, such that the tobacco shreds enter the cigarette paper wrapped on a rolling pipe. When the guide element 57 moves to an end along the guide part 5212, the discharge pipe 31 also moves to a top. During this process, the swing arm 52 contacts with the swing third push element 63 and drives the third push element 63 to swing backward. The third push element 63 rotates to push the second push element 62 to retreat, such that an end of the second push element 62 is separated from the roll opening 21, which is convenient for extracting the cigarette paper loaded with the tobacco shreds. In this way, a cigarette making process is completed.

In a fifth step, no external force is applied to the handle 59. The torsion spring 56 releases the elastic potential energy and drives the drive wheel 55 to rotate in reverse. The drive wheel 55 rotates reversely and drives the guide element 57 to exit along the guide part 5212 to the arc part 5211. The drive wheel 55 rotates in reverse and drives the drive shaft 51 in reverse. The handle 59 swings backward with the drive shaft 51. The swing arm 52 drives the slider 33 and drives the discharge pipe 31 backward to the initial position.

The first to fifth steps are repeated for each subsequent cigarette making process.

In the description of the present disclosure, it should be understood that orientations or position relationships indicated by terms, such as "center", "length", "left", "right", "front", "rear", "width", "thickness", "upper", "lower", "vertical", "horizontal", "top", "bottom", "inside", and "outside", are orientations or position relationships as shown in the drawings, for ease of describing the present disclosure and simplifying the description, rather than indicating or implying that the mentioned devices or elements must have a specific orientation and must be established and operated in a specific orientation, and thus, these terms cannot be understood as a limitation to the present disclosure. In addition, the terms "first" and "second" are merely intended for a purpose of description, and shall not be understood as an indication or implication of relative importance or implicit indication of a quantity of indicated technical features. Thus, features defined with "first" and "second" may explicitly or implicitly include one or more of the features. In the description of the present disclosure, the term "a plurality of" means two or more, unless otherwise specifically defined.

Overall, the above described are only preferred embodiments of the present disclosure, and all equivalent variations made within the protection scope of the present disclosure should fall within the protection scope of the present disclosure.

What is claimed is:

1. A manual cigarette maker, comprising a housing and a mounting frame fixed inside the housing, wherein a front side of the mounting frame is provided with a discharge assembly, and a middle part of the mounting frame is provided with a pressing assembly; the discharge assembly comprises a discharge pipe; the pressing assembly comprises a pressing element; a pressing chamber for pressing a material is formed between a front side of the pressing element and the discharge pipe; the pressing assembly is linked with the discharge pipe through a drive assembly; the drive assembly comprises a rotatable drive shaft, a swing arm, a linkage, and a drive plate; the swing arm is configured to link the discharge pipe and the rotatable drive shaft; a drive wheel is provided on the rotatable drive shaft and rotates synchronously with the rotatable drive shaft; the linkage comprises a gear part provided on a side and a connecting part provided at a front side; the gear part is meshed with the drive wheel; and a front side of the drive plate is hinged with the pressing element, and a rear side of the drive plate is hinged with the connecting part of the linkage.

2. The manual cigarette maker according to claim 1, wherein continuous helical teeth are circumferentially arranged on a side surface of the drive wheel; the drive wheel is further provided with a smooth surface; the gear part of the linkage is a helical gear; when the continuous helical teeth of the drive wheel are meshed with the gear part of the linkage, the drive wheel rotates horizontally and drives the gear part to rotate in a vertical plane; and when the smooth surface of the drive wheel is connected to the linkage, the drive wheel rotates horizontally and the gear part does not rotate.

3. The manual cigarette maker according to claim 2, wherein the drive wheel is provided with a torsion spring; an end of the torsion spring extends out of the drive wheel to a position at a junction between the continuous helical teeth and the smooth surface of the drive wheel; the gear part of the linkage is fan-shaped; a front side of the gear part forms an end surface provided with a clamping groove; and when the smooth surface of the drive wheel is connected to the linkage, an extended part of the torsion spring butts into the clamping groove and provides an elastic force for reverse rotation of the drive wheel.

4. The manual cigarette maker according to claim 2, wherein an end of the swing arm is rotatably mounted on the mounting frame; the swing arm is provided with a guide groove; a guide element is provided on the rotatable drive shaft and moves synchronously with the rotatable drive shaft; the guide groove comprises an arc part and a guide part; when the continuous helical teeth of the drive wheel are meshed with the gear part of the linkage, the guide element slides along the arc part; and when the smooth surface of the drive wheel is connected to the linkage, the guide element slides along the guide part and pushes the swing arm to swing.

5. The manual cigarette maker according to claim 4, wherein an angle is formed between the arc part and the guide part of the guide groove; and a groove wall of the arc part is shaped as a circular arc, with a center located on a central axis of the rotatable drive shaft.

6. The manual cigarette maker according to claim 4, wherein the guide element is cylindrical, and is mounted on the rotatable drive shaft through a mounting element; the mounting element is fixedly connected to the rotatable drive shaft; and a cylindrical side surface of the guide element is in contact with the guide groove.

7. The manual cigarette maker according to claim 1, wherein the discharge assembly further comprises a discharge guide rail and a slider; the slider slides on the discharge guide rail; the slider is connected to the discharge pipe and drives the discharge pipe to move laterally; the slider is connected to the swing arm through a linkage arm; and a first end of the linkage arm is hinged with the slider, and a second end of the linkage arm is connected to a front end of the swing arm.

8. The manual cigarette maker according to claim 1, wherein the rotatable drive shaft is connected to a handle for driving the rotatable drive shaft to rotate.

9. The manual cigarette maker according to claim 1, wherein when the pressing element moves backward, the housing forms a material inlet corresponding to the pressing chamber between the pressing element and the discharge pipe.

10. The manual cigarette maker according to claim 1, further comprising a roll opening and a paper pressing assembly, wherein the discharge pipe is configured to protrude from the roll opening when moving laterally; the paper pressing assembly comprises a first push element, a second push element and a third push element, wherein the first push element and the second push element are provided on a side of the mounting frame, and a third push element is provided on the mounting frame; the first push element is eccentrically connected to the linkage; the first push element moves forward and pushes a front end of the second push element to butt with the roll opening; and when the swing arm swings to a side of the roll opening, the swing arm contacts with the third push element and drives the third push element to rotate, and the third push element rotates to push the second push element to retreat.

* * * * *